US006557449B1

(12) United States Patent
O'Dwyer

(10) Patent No.: US 6,557,449 B1
(45) Date of Patent: May 6, 2003

(54) FIREARMS

(75) Inventor: James Michael O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 09/445,025

(22) PCT Filed: Jun. 2, 1998

(86) PCT No.: PCT/AU98/00415

§ 371 (c)(1),
(2), (4) Date: Dec. 3, 1999

(87) PCT Pub. No.: WO98/55819

PCT Pub. Date: Dec. 10, 1998

(30) Foreign Application Priority Data

Jun. 3, 1997 (AU) ..... PO7158

(51) Int. Cl.[7] ..... B64D 1/04; F41A 3/00

(52) U.S. Cl. ..... 89/1.41; 89/28.05; 89/135; 89/126; 89/27.13

(58) Field of Search ..... 89/1.41, 28.05, 89/28.1, 135, 126, 14.05, 27.13

(56) References Cited

U.S. PATENT DOCUMENTS 4,222,306 A * 9/1980 Maury ..... 89/1.41
5,259,289 A * 11/1993 Peries et al. ..... 89/1.41

FOREIGN PATENT DOCUMENTS

WO WO 94/20809 9/1994
WO WO 97/04281 2/1997

* cited by examiner

*Primary Examiner*—J. Woodrow Eldred
(74) *Attorney, Agent, or Firm*—Oblon, Spivak, McClelland, Maier & Neustadt, P.C.

(57) ABSTRACT

This invention provides a handgun assembly such as a rifle (9) which has a barrel assembly (24) including a cluster of barrels each supporting a longitudinal arrangement of aerodynamically shaped, directional projectiles (15) and interposed propellant charges (16) whereby the barrel assembly has longitudinal arrays or layers or projectiles and interposed propellant charges. Ignition means is provided for selectively igniting the propellant charges (16) including for simultaneously igniting the propellant charges in the leading layer of projectiles to provide a shotgun-like blast.

21 Claims, 8 Drawing Sheets

FIREARMS

TECHNICAL FIELD

The invention relates to firearms.

1. Background Art

This invention has particular, but not exclusive, application to a handguns including shotgun type firearms which utilise barrels such as the barrels described in my earlier International Patent Applications Nos. PCT/AU94/00124 and PCT/AU96/00459.

Such barrels each have a plurality of projectiles stacked axially within the barrel together with discrete selectively ignitable propellant charges for propelling the projectiles sequentially through the muzzle of the barrel and the sealing engagement between projectiles and barrel being such as to prevent rearward travel of the ignited propellant charge to trailing propellant charges. These barrels will be referred to hereinafter as of the type described.

This invention aims to alleviate perceived shortcomings in conventional weapons such as shotguns which fire a collection of round pellet like shot randomly oriented in the cartridge, which when fired exit from a relatively large bore barrel in a random orientation and at a relatively slow muzzle velocity.

The shot immediately disperses to cover a relatively large target zone. This effect is useful but the effective range of the shot is very short. Shotguns also require reloading between shots and this reduces their effectiveness.

Handguns such as pistols also have significant limitations for many reasons including the limited number of shots which may be contained in the weapon and the relatively slow rate of fire available. However they are very portable and concealable and this makes them very useful.

2. Disclosure of Invention

According to one aspect this invention resides broadly in a shotgun assembly having:

a cluster of small bore barrels of the type described each having a longitudinal arrangement of aerodynamically shaped, directional projectiles and interposed propellant charges whereby the barrel assembly has longitudinal arrays or layers of projectiles and interposed propellant charges arranged in longitudinally spaced relationship in their respective barrels, and ignition means for simultaneously igniting the propellant charges in a respective layer of propellant charges.

According to one aspect this invention resides broadly in a shotgun assembly having:

a barrel assembly including a cluster of barrels of the type described;

each barrel including a longitudinal arrangement of aerodynamically shaped, directional projectiles and interposed propellant charges whereby the barrel assembly has longitudinal arrays or layers of projectiles and interposed propellant charges, and ignition means for simultaneously igniting the propellant charges in a respective layer of propellant charges.

The foregoing may form the entire barrel assembly of the handgun or the barrel assembly may constitute only a portion of the handgun's barrel assembly, such as by being a replaceable cartridge communicating with fixed barrels in the handgun. The barrels may be parallel or may splay slightly to achieve a desired firing pattern.

Each barrel may have its own electronic ignition means. Preferably however the barrels are clustered about one or more ignition passages extending substantially parallel to the barrels and communicating therewith through longitudinally spaced arrays of transverse bleed passages so as to selectively initiate ignition of primers in the or each ignition passage spreads through the respective aligned one of the longitudinal array of transverse bleed passages and causes ignition of the respective propellant charges communicating therewith.

The barrels may also be clustered about one or more bypass passages extending substantially parallel to the barrels and communicating therewith through a valved port communicating with longitudinally spaced arrays of transverse bleed passages whereby in the event of an accidental ignition of a primer in a trailing round, the valved port will open to enable the ignited propellant charges to bleed to atmosphere through the bypass passage.

Alternatively, individual barrels may be provided with valved ports enabling each to discharge to a bypass passage in the event of a hang fire or similar accidental ignition of a trailing propellant charge. Suitably the valved port is in the form of a plugged port in which the plug will be dislodged at a preselected pressure above the normal operating pressures within the barrels.

The handgun may be in the form of a shotgun and have a large number of small bore barrels clustered about the or each ignition passage, but preferably a central ignition passage. The ignition passage may constitute a main barrel provided with primer initiation means for selective initiation of the propellant charges therein. The main barrel is suitably the center barrel and may have a larger bore than the others if desired.

For example, a cluster of approximately sixty-four 2 mm barrels could be provided. This provides a shotgun in which all the simultaneously fired projectiles are individually barrelled. The projectiles would be in the order of 2 mm diameter and 5 mm in length. If the leading primer in the main barrel is ignited, then all sixty-four projectiles in the leading layer will be fired.

The barrels may be rifled and the projectiles may be loaded therein in cartridges. Alternatively the barrel may be provided as a disposable barrel containing the projectiles and propellant charges stacked therein.

The cartridges could align with a single large open barrel of the shotgun but preferably the barrels of the cartridge align with correspondingly arranged small bore barrels in the shotgun. For this purpose the cartridge is provided with locating means for locating it in operative alignment with the shotgun barrels and most preferably the cartridge has a square section housing for operative location with any of its rectangular side faces entered through the loading\ejection port. This port could be a side, top or underside port.

Any number of groups of sixty-four pellets/projectiles may be fired at any electronically available rate. This provides on the one hand, a low degree of lethality in the case where say a single group of pellets is fired, or an exceedingly high degree of lethality if a number of groups are fired in rapid succession. The weapon may be operated as a shotgun machine-gun.

The primer initiation is suitably electronically controlled and may be electrical, chemical, laser, mechanical or any other available means as is appropriate.

In yet a further aspect this invention resides in a method of igniting the propellant charges for rounds in a cluster of barrels, including:

providing an ignition passage containing a longitudinal array of primers and communicating with corresponding propellant charges in the barrels through respective longitudinally spaced arrays of bleed passages, and selectively and sequentially igniting the primers in the ignition passage to causes ignition of the respective propellant charges communicating therewith.

BRIEF DESCRIPTION OF THE DRAWINGS

In order that this invention may be more readily understood and put into practical effect, reference will now be made to the accompanying drawings which illustrate typical embodiments of the invention, wherein.

DESCRIPTION OF THE PREFERRED EMBODIMENTS

Figure 1:
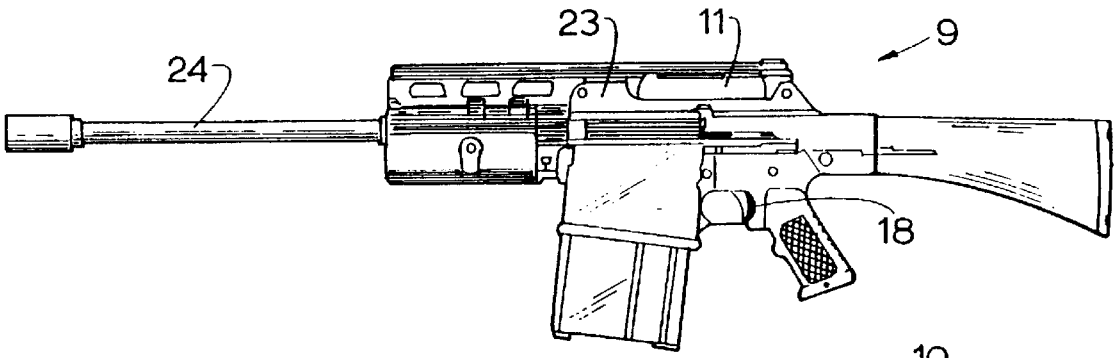
FIGS. 1 and 2 illustrate typical shotguns according to this invention.
Figure 2:
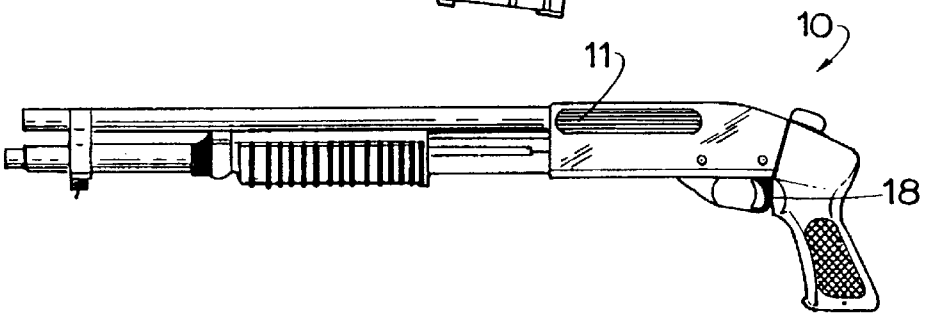

The shotguns 9 and 10 illustrated in FIGS. 1 and 2 are similar to the Smith & Wesson AS and the Remington 870 twelve gauge shotguns respectively and have similar loading and unloading features.

Figure 3:
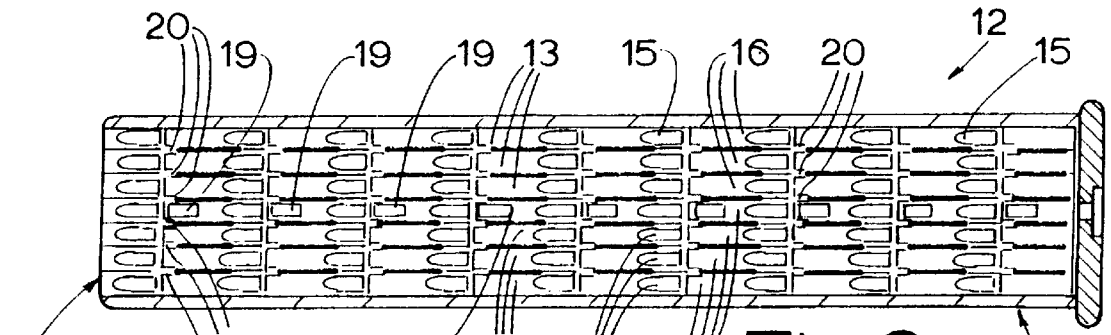
FIG. 3 is a diagrammatic sectional view of a shotgun cartridge for the shotguns illustrated in FIGS. 1 and 2.
Figure 4:
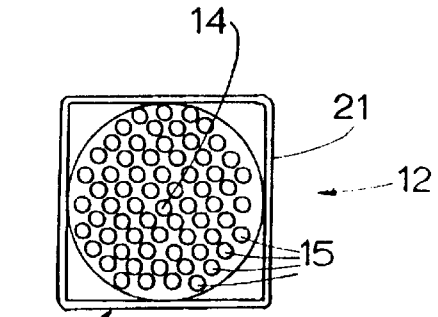
FIG. 4 is an end view of the cartridge illustrated in FIG. 2.
Figure 5A:
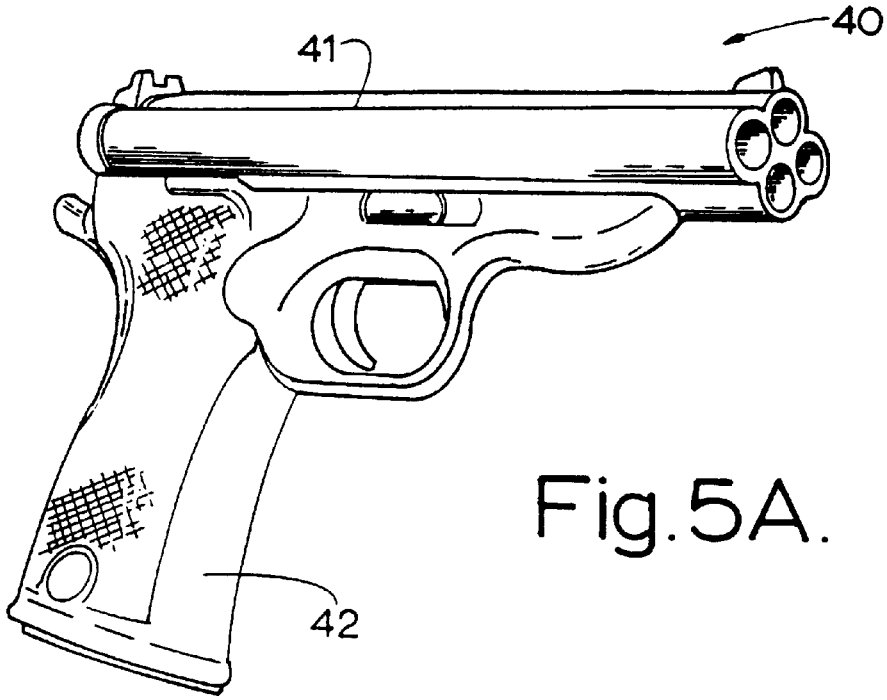
FIGS. 5A to 5D illustrate loading of one preferred form of handgun.
Figure 5B:
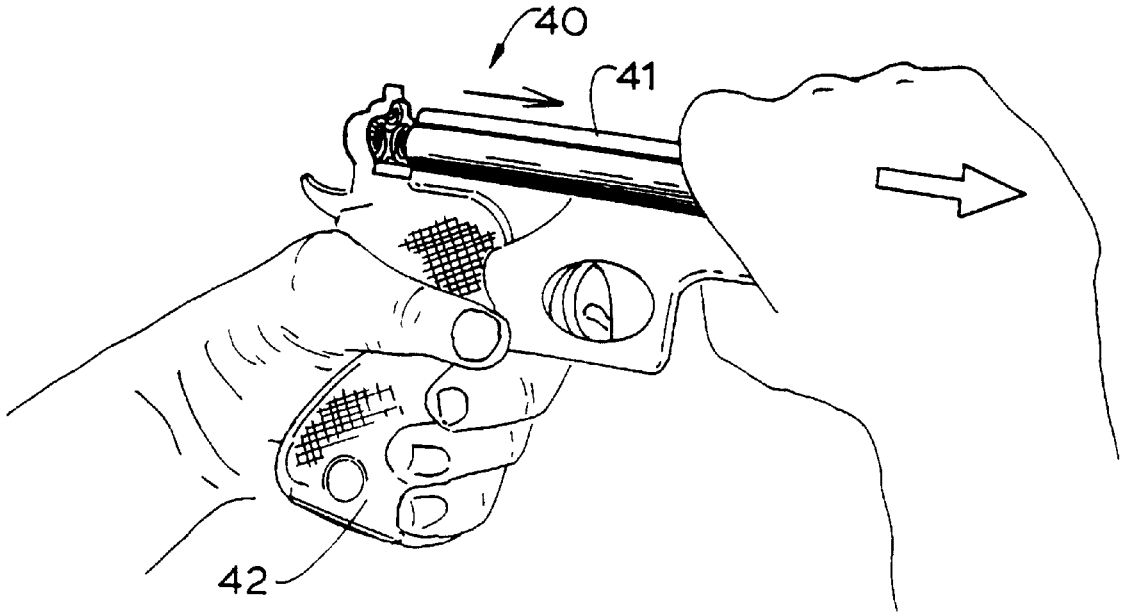
Figure 5C:
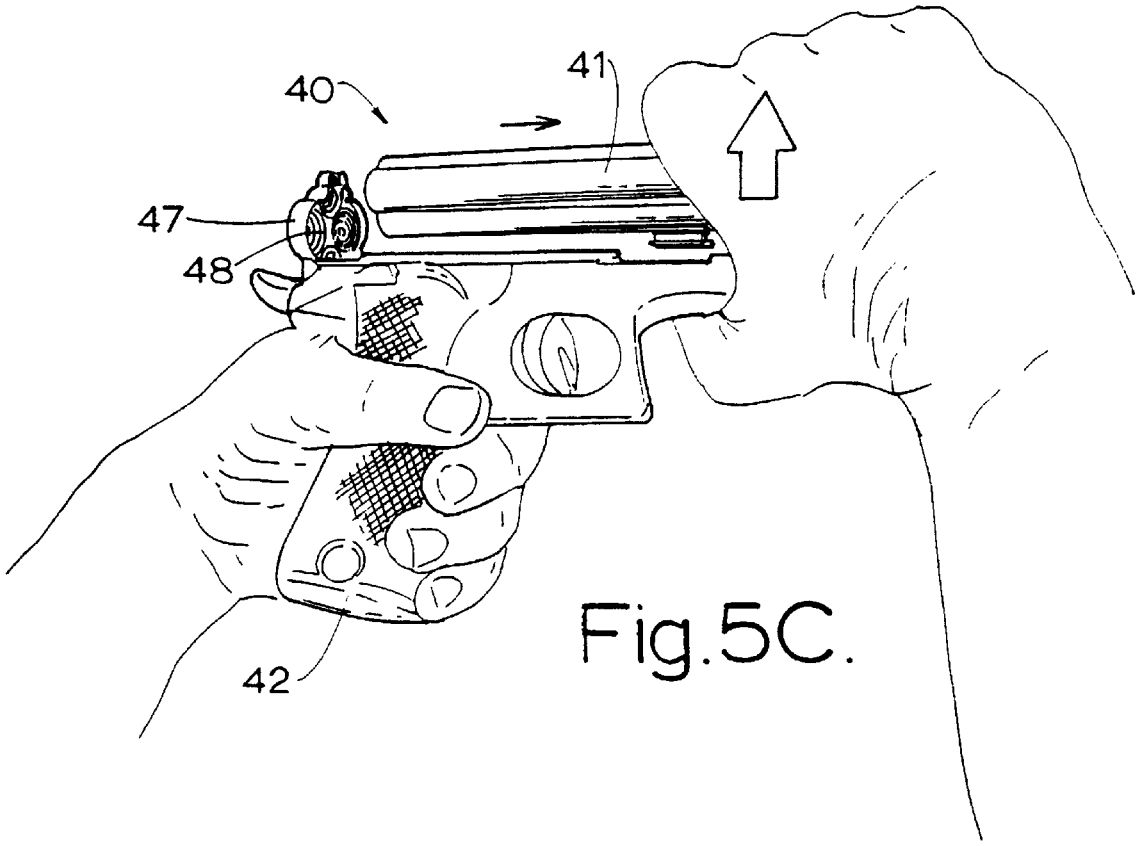
Figure 5D:
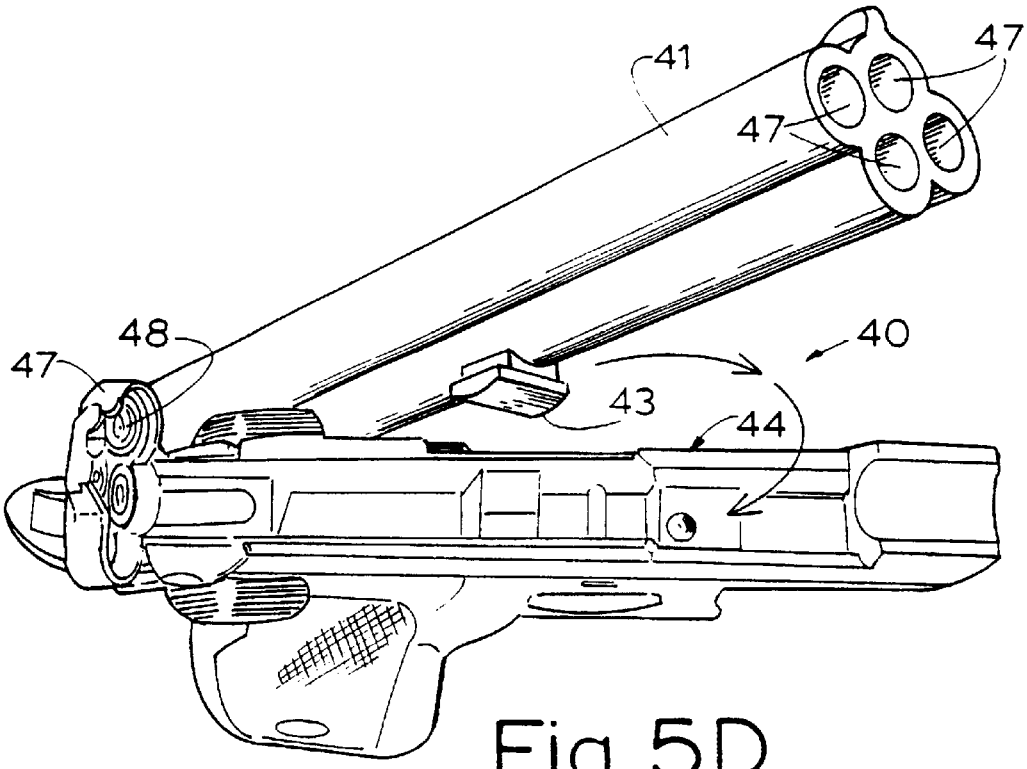

However in each case, the feed injection port 11 has been lengthened to accept a multi-barrel cartridge 12 as illustrated in FIGS. 3 and 4 which contains sixty (60) 2 mm bore barrels 13 arranged symmetrically about a central main barrel 14, with nine longitudinally spaced layers of streamlined directional projectiles 15 and associated propellant charges 16 therein.

The main barrel 14 is provided with electrical connections controlled from electronic control means located in the butt of the shotgun and activated by the trigger 18 in a conventional manner. The electrical connections are controlled for selective ignition of the primers 19 in the respective propellant charges 16 and an array of bleed ports 20 is provided to place the corresponding propellant charges 16 in the barrels 13 in communication with the respective propellant charges in main barrel 14.

Upon ignition of the leading propellant charge 16 in the main barrel 14, the explosion front will spread through the bleed ports 20 and ignite all the propellant charges in the corresponding layer.

The barrels 13 are clustered in a circular configuration about the main barrel 14 and are supported in a square sectioned housing 21 which may be introduced into the port feed end 22 first in any desired rotational attitude. The square housing 21 is used to positively locate the cartridge in the shotgun body 23 in alignment with the correspondingly clustered barrel assembly 24 extending from the body 23.

Figure 9:
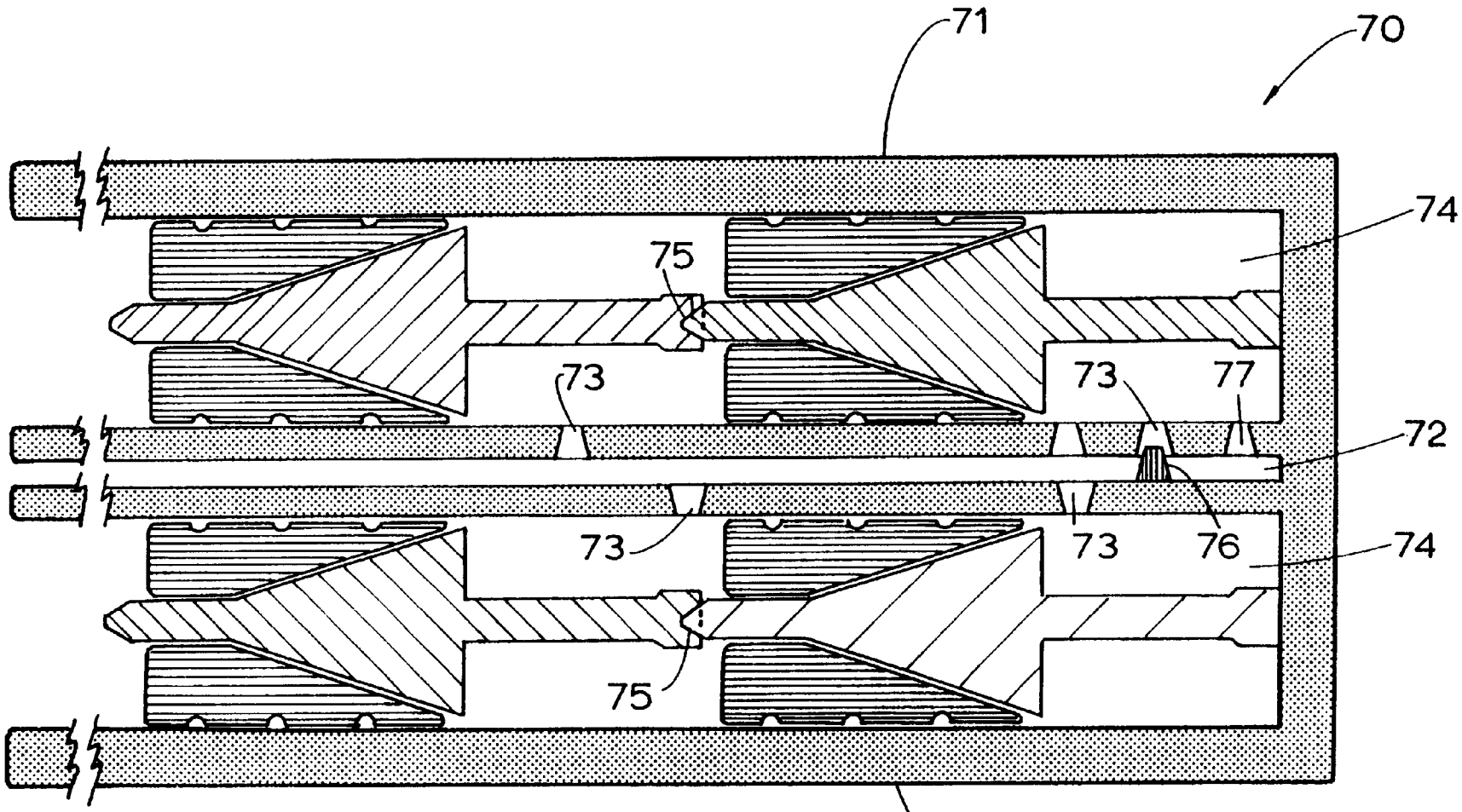
FIG. 9 illustrates a further form of clustered barrel assembly.

In operation of the shotgun illustrated in FIG. 9, when its controls are set to fire single arrays of projectiles 15 at a time, the bolt may be locked for manual cocking, in which case the recoil is negated. However if three or more layers of projectiles 15 are to be fired substantially simultaneously, such as to empty the operative cartridge, the bolt may be unlocked to enable the recoil action to automatically cock the weapon for its next firing, including ejection of the fired cartridge.

The shotgun illustrated in FIG. 2 utilizes a pump action for reloading cartridges in a conventional manner. The projectiles 15 are suitably formed with a reverse wedging sealing arrangement as described in corresponding International application filed Jun. 1, 1998 of the inventor or they may utilize a forward wedging arrangement as described in the earlier filed International patent applications of the inventor set out above.

Figure 6A:
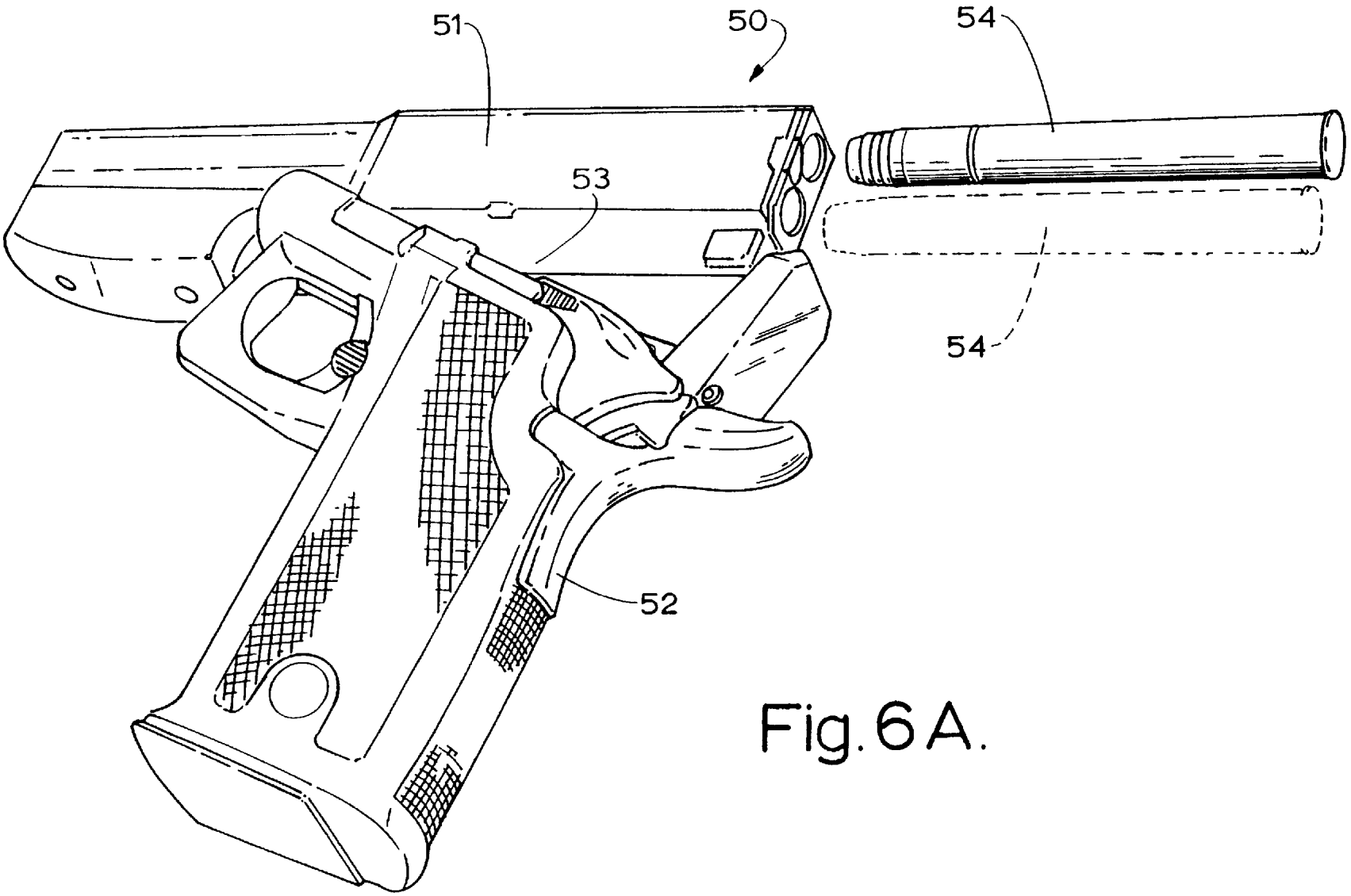
FIGS. 6A and 6B illustrate loading of a further preferred form of handgun.
Figure 6B:
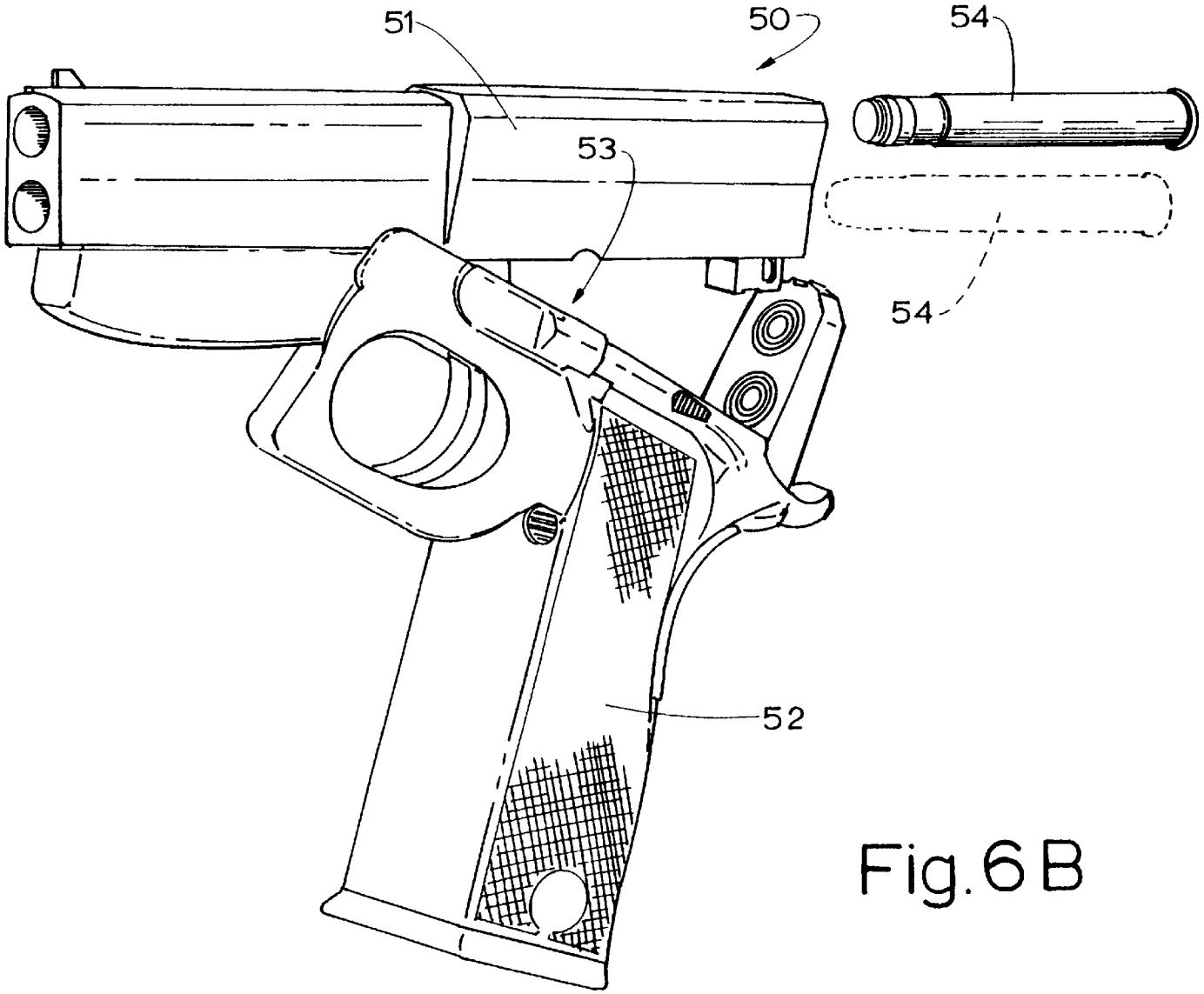
Figure 7:
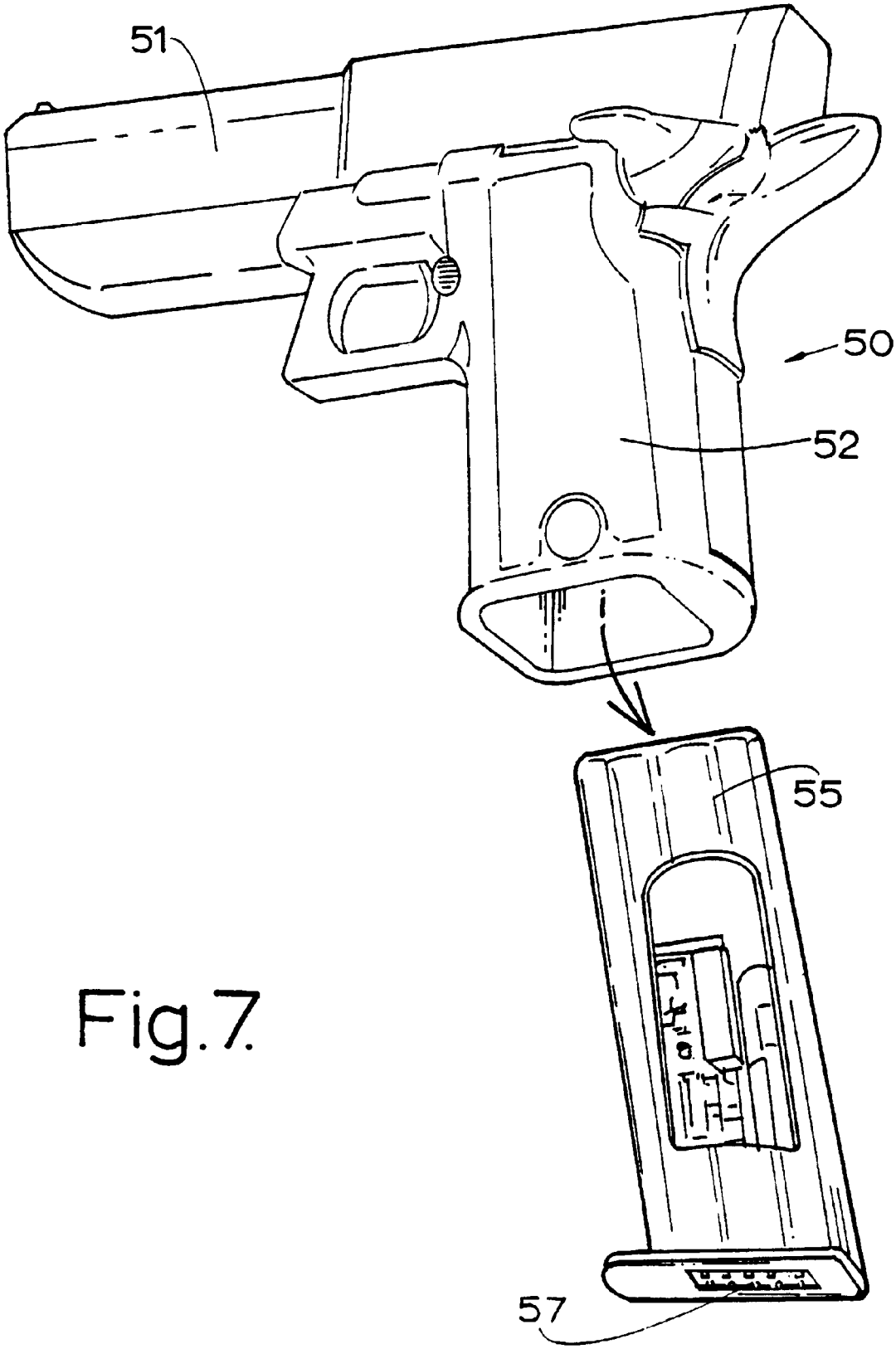
FIG. 7 illustrates the removal of electronic control means for disarming the revolvers.

FIGS. 5, 6 and 7 herewith illustrate two pistols according to further aspects of the present invention. The illustrated pistols include a four barrel pistol 40 in which the barrel assembly 41 is removable from the hand grip assembly 42 and a two barrel pistol 50 in which the barrel assembly 51 breaks from the hand grip assembly 52 for reloading.

Referring firstly to the four barrel pistol 40, it will be seen that the barrel assembly 41 which comprises four integrated barrels clustered together and provided with an integral mounting 43 which enables the barrels to be clipped into a cradle assembly 44 which extends above and forwardly of the hand grip 42.

Suitable latching means 45 are provided for maintaining the barrel assembly in its operative position in the cradle assembly 44. The process of removal of the barrel assembly 41 is illustrated sequentially in the drawings. In the first step illustrated in FIG. 5B, the barrel assembly 51 is withdrawn longitudinally from the end cap 47 which contains concentrically arranged electrical contacts 48 which mate with corresponding contacts in the end of the barrel assembly 41 to provide electrical ignition control of the propellant charges therein.

Because the barrel assembly 41 can be readily detached and attached to the cradle assembly 44, this pistol assembly 40 offers the advantage that a user may carry alternate style barrel assemblies for firing different types of projectiles or for rapid reloading should one barrel assembly be emptied or required to be changed in use.

All barrels need not contain the same projectiles. One or more could for example contain a shotgun barrel as described above if desired while the others may contain banks of single projectiles with the same or different propellant charges. Selection switches would be provided to enable a user to fire selected or all barrels. Alternatively they could be mounted about a main passage with bleed passages for simultaneous ignition of all rounds in each respective layer of projectiles.

The barrel assemblies 41 can be of a disposable form or they may be adapted to receive reload cartridges which are inserted into the rear of the respective barrels. Suitable release claws or the like are also supported on the upstanding butt portion 46, which is integral with the hand grip 42, catch the cartridges upon release of the barrel to effect partial withdrawal of spent or partially spent cartridges and thus facilitate their removal for replacement.

If desired the barrel assembly 41 may be supported on a slide and associated with recoil or damping means to minimize the reaction upon firing. This recoil would be particularly useful in an instance where a user required to file a number of projectiles simultaneously or in quick succession. That is operation of the pistol 40 in a normal manner would provide the normal controllable reaction.

However if the rapid fire facilities available to a user of handguns of the present invention are utilised, the reaction, without damping may render the handgun uncontrollable.

Figure 8:
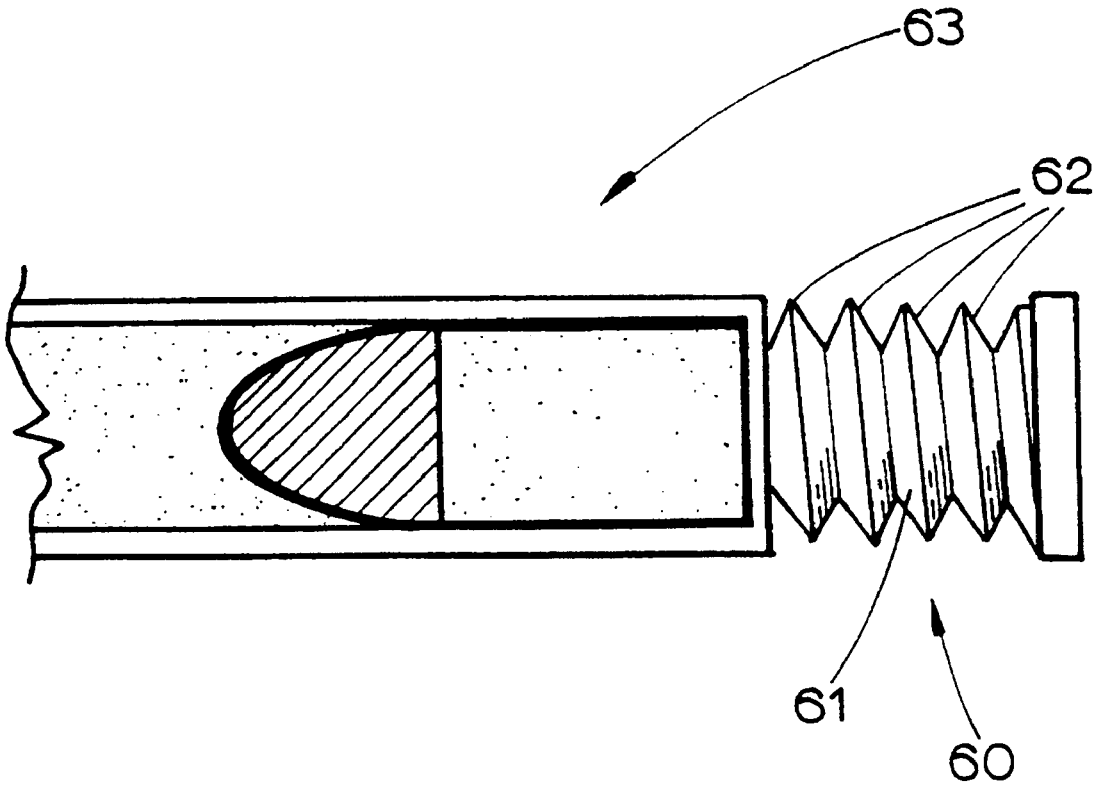
FIG. 8 illustrates one form of cartridge which may be used with the handgun of FIG. 6.

Thus a recoil mechanism for handguns programmed with a rapid fire facility, such as is illustrated in FIG. 8, would be most desirable.

The two barrel pistol 50 illustrated in FIG. 7 has the barrel assembly 51 arranged for pivotal movement at the front end of the cradle 53 so that the barrel may be broken for reloading with cartridges. The pistol 50 receives double tap cartridges 54 of the type described in my International Patent Application No. PCT/AU96/00459. This is particularly significant in relation to handguns of the present invention in that the cartridges loaded into each of the barrels may be of different configuration and be operable so that an operator may selectively fire rounds from either barrel such as rounds which have a low lethality or rounds which have a high lethality.

In both pistols 40 and 50 actuation is by means of a trigger which is in effect an electronic switch. This switch could be sensitive to displacement and/or pressure to enable trained personnel to operate the weapon for selective firing of single or multiple rounds and of different types.

The pistol assembly 50 has a control insert 55 which fits into a complementary recess in the pistol grip 52, or grip 42 of pistol 40, and which contains the electronic firing controls, a memory for storing recorded data and other required electronics, including diagnostics. The plug-in insert 55 includes a multipin connector at its inner end which engages with a complementary connector when the insert is pushed into the grip 52 to the fully home position. At the base of the insert 55, a further multipin connector 57 is provided to enable the electronics therein to be accessed to enables programming of the electronics and display of stored data for desired functions and results on a screen. Concentrically arranged contacts 58 are provided for barrel control.

The insert 55 enables a user to secure the pistol against unauthorized use. If desired further security measures may be taken as is described in one of the co-pending International Patent Applications of the inventor.

FIG. 8 illustrates a collapsible stack 60 formed of shock absorbing material 61 and disposed at the rear end of an electronically fired round 63. The stack 60 has sections 62 which collapse progressively upon firing the projectiles in the round. In this manner, recoil damping can be built into a fixed barrel weapon which uses replaceable cartridge assemblies. Furthermore, an operator may use rounds with or without the damping means.

The barrel assembly 70 illustrated in FIG. 9 has barrels 71 clustered about a central bypass passage 72 provided with at least one bleed port 73 associated with the propellant charge 74 of each trailing projectile 75. The ports 73 are provided with plugs as illustrated at 76, which are discharged from the ports 73 when a predetermined pressure is exceeded locally in the barrels 71 so as to bleed the excess pressure to atmosphere through the bypass passage 72.

If desired, more than one port, as illustrated at 77, may be utilized to provide a greater port bleed area for extreme high pressures.

It will of course be realized that the above has been given only by way of illustrative example of the invention and that all such modifications and variations thereto as would be apparent to persons skilled in the art are deemed to fall within the broad scope and ambit of the invention as is defined in the appended claims.

The claims defining this invention are as follows:

1. A shotgun assembly which comprises:

barrel assembly including a cluster of barrels, each barrel having a plurality of aerodynamically shaped projectiles axially disposed within the barrel together with interposed selectively ignitable propellant charges for propelling the projectiles sequentially through the muzzle of the barrel and a sealing engagement between the projectiles and the barrel wherein;

each barrel includes a longitudinal arrangement of aerodynamically shaped projectiles and interposed propellant charges whereby the barrel assembly has longitudinal arrays or layers of the projectiles and interposed propellant charges of said selectively ignitable propellant charges are disposed substantially transversely within the barrel assembly, and ignition means for simultaneously igniting the propellant charges in a selected layer of said propellant charges.

2. A shotgun assembly as claimed in claim 1, wherein the barrel assembly includes a replaceable cartridge communicating with fixed barrels supported in the shotgun assembly.

3. A shotgun assembly as claimed in claim 1 or claim 2, wherein the barrels are clustered about one or more ignition passages extending substantially parallel to the barrels and communicating therewith through longitudinally spaced arrays of transverse bleed passages.

4. A shotgun assembly as claimed in claim 3, wherein the ignition passage comprises a main barrel provided with primer initiation means for selective initiation of the propellant charges therein.

5. A shotgun assembly as claimed in claim 4, wherein the main barrel comprises a control barrel which has a larger bore than other barrels of said cluster of barrels.

6. A shotgun assembly as claimed in claim 1, wherein the barrels are clustered about one or more bypass passages extending substantially parallel to the barrels and communicating therewith through respective pressure sensitive bypass means.

7. A shotgun assembly as claimed in claim 6, wherein the bypass means comprises a valved port in the wall of the bypass passage for communicating with longitudinally spaced arrays of transverse bleed passages associated with each propellant space.

8. A shotgun assembly as claimed in claim 1 wherein said barrel assembly comprises a shotgun having a plurality of small bore barrels clustered about the or each ignition passage.

9. A shotgun assembly as claimed in claim 8 wherein said barrel assembly comprises a shotgun and said projectiles are formed with reverse wedge sealing means.

10. A method of igniting the propellant charges for rounds in a cluster of barrels, said method comprising:

providing an ignition passage containing a longitudinal array of primers and communicating with corresponding propellant charges in the barrels through respective longitudinally spaced arrays of bleed passages, and selectively and sequentially igniting the primers in the ignition passage for causing ignition of the respective propellant charges communicating therewith.

11. A method as claimed in claim 10, wherein the barrels are clustered about the ignition passage.

12. A method as claimed in claim 10 or claim 11, wherein the communication with said charges is through a valved port normally communicating with a respective array of bleed passages and which is able to communicate with a bleed passage to relieve excess pressures.

13. A shotgun assembly, which comprises:

a barrel assembly including a cluster of barrels, each of said barrels including a longitudinal arrangement of aerodynamically shaped projectiles and interposed propellant charges such that the barrel assembly has one of a longitudinal array of said projectiles and layers of said projectiles and interposed propellant charges, and ignition means for simultaneously igniting the propellant charges in a respective layer of the propellant charges wherein the barrel assembly includes a replaceable cartridge communicating with fixed barrels supported in the shotgun assembly and wherein the barrels are clustered about one or more ignition passages extending substantially parallel to the barrels and communicating therewith through longitudinally spaced arrays of transverse bleed passages.

14. A method as claimed in claim 10, wherein each of said barrels has a plurality of aerodynamically shaped projectiles axially disposed within the barrel together with interposed selectively ignitable propellant charges for propelling the projectiles sequentially through a muzzle of the barrel and a sealing engagement between the projectiles and the barrel.

15. A shotgun assembly as claimed in claim 13, wherein ignition passage comprises a main barrel provided with primer initiation means for selective initiation of the propellant charges therein.

16. A shotgun assembly as claimed in claim 15, wherein the main barrel comprises a central barrel which has a larger bore than the other barrels.

17. A shotgun assembly as claimed in claim 13, where the barrels are clustered about one or more bypass passages extending substantially parallel to the barrels and communicating therewith through a respective pressure sensitive bypass means.

18. A shotgun assembly as claimed in claim 17, wherein the bypass means comprises a valve to port in the wall of the bypass passage for communicating with longitudinally spaced arrays of said transverse bleed passages.

19. A shotgun as claimed in claim 13, wherein said barrel assembly comprises a shotgun having a plurality of small bore barrels clustered about the or each ignition passage.

20. A shotgun assembly as claimed in claim 19, wherein said barrel assembly comprises a shotgun and said projectiles are formed with reverse wedge sealing means.

21. A shotgun assembly, which comprises:

a barrel assembly including a cluster of barrels, each of said barrels including a longitudinal arrangement of aerodynamically shaped projectiles and interposed propellant charges such that the barrel assembly has one of a longitudinal array of said projectiles and layers of said projectiles and interposed propellant charges, and ignition means for simultaneously igniting the propellant charges in a respective layer of the propellant charges wherein the barrels are clustered about one or more ignition passages extending substantially parallel to the barrels and communicating therewith through longitudinally spaced arrays of transverse bleed passages.

* * * * *